US005456062A

United States Patent [19]

Wechsler

[11] Patent Number: 5,456,062

[45] Date of Patent: Oct. 10, 1995

[54] DECORATIVE PACKAGE WRAP

[76] Inventor: Lana Wechsler, 1125 Park Ave., #11A, New York, N.Y. 10128

[21] Appl. No.: 120,423

[22] Filed: Sep. 13, 1993

[51] Int. Cl.[6] ..... B65B 5/04; B65B 7/02

[52] U.S. Cl. ..... 53/468; 53/138.7; 53/414; 53/461; 383/117

[58] Field of Search ..... 53/469, 468, 461, 53/284.7, 449, 416, 414, 410, 138.7, 138.6, 139.2, 138.3; 383/117, 118

[56] References Cited

U.S. PATENT DOCUMENTS

| | | | |
|---|---|---|---|
| 2,035,384 | 3/1936 | Hinchliff | 383/118 X |
| 2,447,561 | 8/1948 | Brenner | 383/117 X |
| 2,502,586 | 4/1950 | Ottinger | 53/469 X |
| 2,557,517 | 6/1951 | Scruggs | 383/117 X |
| 3,732,662 | 5/1973 | Paxton | 53/469 X |
| 3,955,227 | 5/1976 | Siegfried | 383/117 X |
| 4,247,005 | 1/1981 | Buxton | 383/117 X |

*Primary Examiner*—James F. Coan

*Attorney, Agent, or Firm*—Fried, Frank, Harris, Shriver & Jacobson

[57] ABSTRACT

A decorative gift wrap for wrapping a package comprising an elongated enclosure formed of a length of stretchable hosiery netting with a closure on each end of the netting enclosure so that the netting enclosure can be stretched to allow a package to be inserted therein and both ends of the netting enclosure closed to create a formfitting decorative wrap for the package, the closure on at least one end being selectively openable to remove the package.

20 Claims, 2 Drawing Sheets

FIG. 1
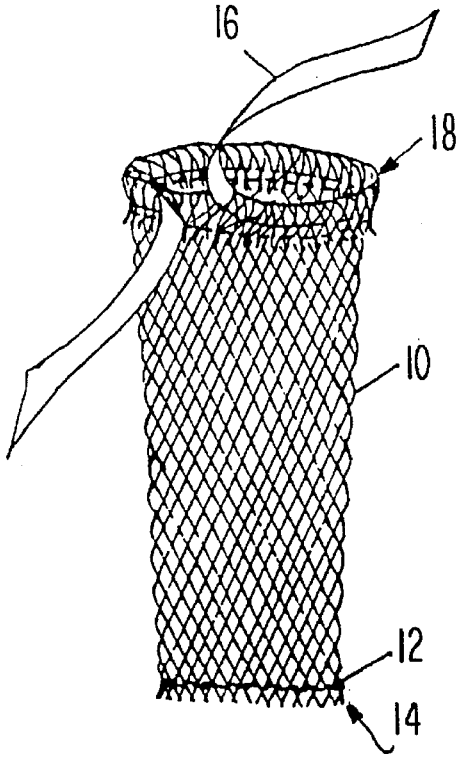
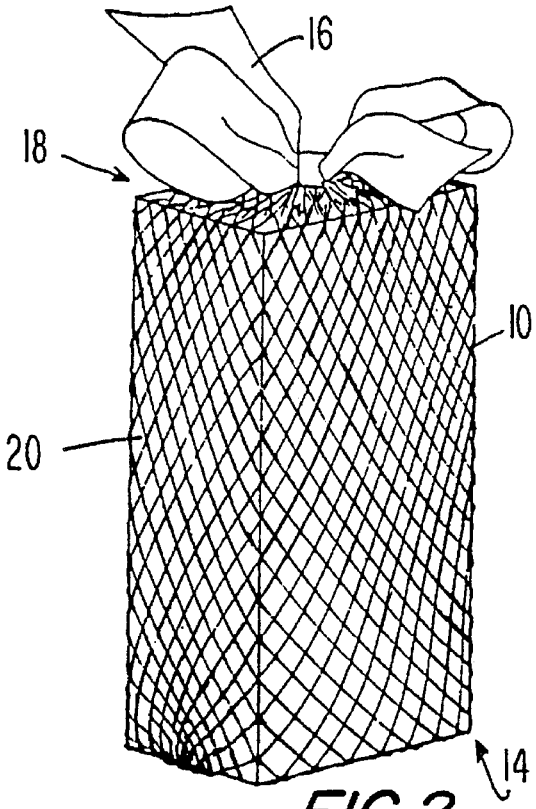
FIG. 2
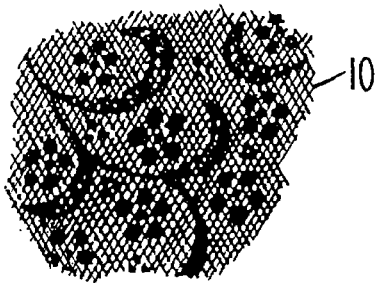
FIG. 3
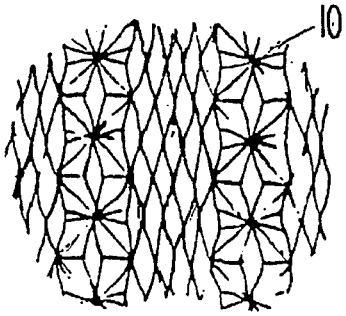
FIG. 4
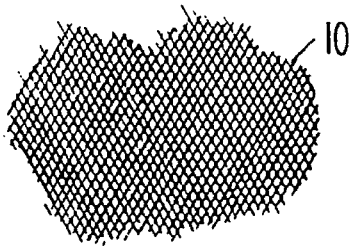
FIG. 5
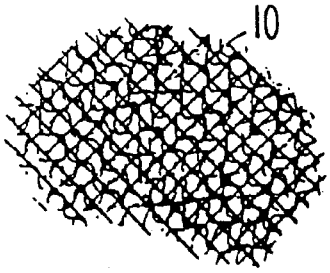
FIG. 6

DECORATIVE PACKAGE WRAP

BACKGROUND OF THE INVENTION

1. FIELD OF THE INVENTION

The present invention relates generally to packaging materials and specifically to a decorative gift wrap that utilizes an elongated enclosure of formfitting hosiery netting with fasteners at each end to allow the netting to be stretched to encompass a package inserted therein and both ends of the elongated netting enclosure closed to creat a formfitting decorative wrap for the package.

2. DESCRIPTION OF THE PRIOR ART

Decorative package materials are well known in the art and include various types of paper having decorative designs thereon that can be folded about a package to enclose it. Generally ribbons are added to the package to complete the decorations.

Such decorative paper and ribbons are not only expensive but, also, in order to provide an attractive package, individuals who are skilled in the art of wrapping the packages must be utilized to provide a package that is neatly wrapped with ribbons attached thereto to form the final product. The time required, even by those skilled individuals, is expensive and, of course, time consuming.

An attractive decorative wrapping material is needed that can be thus secured to the package in a simple and economical manner without requiring skill or an undue length of time.

SUMMARY OF THE INVENTION

The present invention overcomes the disadvantages of the prior art by providing attractive gift wrap packaging formed of hosiery netting in a number of packaging variations to be used as gift wrapping with and without a ribbon. Hosiery netting not only comes in various forms but also has many creative designs thereon. Such hosiery netting may be formed of nylon material, lycra material, lace material, metallic sheen material, patterned material, and the like. Because of the stretchable nature of the hosiery netting, it can be stretched to a allow a package to be inserted in an enclosed length thereof with the ends of the enclosed length closed with some type of fastener that will provide an attractive package. The enclosed length of hosiery netting may have one end fixedly closed and the other end may have a selectively closable fastener such as a ribbon, decorative cord, a mating hook-and-loop combination, decorative buttons with associated fasteners such as snaps or flexible loops that can wrap around the buttons, and the like. Of course, reclosable fasteners may be placed on both ends of the enclosed netting. Thus, there may be ribbon or cord at both ends; there may be a hook-and-loop combination at both ends; there may be a decorative button for the associated fastener at each end; and the like. Such hosiery netting used as packaging material is formfitting about the package, can be formed in various lengths to accommodate a particular package length, and can be formed as an elongated enclosure of any desired diameter to accommodate any particular sized package. The only requirement is that the hosiery netting be stretchable so that the package can fit therein and then both ends of the elongated netting closed with some type of closure to create a formfitting decorative wrap for the package. At least one of the closures may be selectively openable to remove the package.

Thus it is an object of the present invention to provide to gift wrap material that is formed of stretchable hosiery netting.

It is another object to the present invention to provide a decorative gift wrap using stretchable hosiery netting in the form of an elongated enclosure that has a closure on at least one end thereof.

It is also an object of the present invention to provide a decorative gift wrap using stretchable hosiery netting in the form of an elongated enclosure that has a closure on each end thereof with at least one of the closures being adjustable to selectively open and close one end of the netting enclosure.

It is yet another object of the present invention to provide a decorative gift wrap in the form of an elongated enclosure of stretchable hosiery netting wherein nylon hosiery material is used for the netting.

It is still another object of the present invention to form a decorative gift wrap for a package using stretchable hosiery netting in the form of an elongated enclosure that is formed of lycra material, lace material, metallic sheen material, patterned material, and the like.

It is also another object of the present invention to provide a decorative gift wrap for a package formed of stretchable hosiery netting in the form of an elongated enclosure which has a selectively operable closure that is formed of a decorative ribbon, a mating hook-and-loop fastener, and at least one decorative button with an associated fastener on either or both ends of the stretchable hosiery netting enclosure.

BRIEF DESCRIPTION OF THE DRAWINGS

These and other objects of the present invention will be more fully disclosed when taken in conjunction with the following detailed description of the drawings in which like numerals represent like elements and in which:

FIG. 1 is a side view of a novel decorative gift wrap of the present invention illustrating an enclosed length of stretchable hosiery netting with one end fixedly closed and the other end adjustably closed by a ribbon-type drawstring;

FIG. 2 is an isometric view of a package inserted in the novel enclosed decorative gift wrapping length of stretchable hosiery netting depicted in FIG. 1 to illustrate the decorative package formed thereby;

FIG. 3 is a partial view of a decorative stretchable hosiery netting that has a pattern thereon;

FIG. 4 is a partial view of a lace-type stretchable hosiery netting that can be used to form the decorative package of FIG. 1;

FIG. 5 is a partial view of nylon or lycra hosiery material that could be used for the stretchable hosiery netting to be used for the decorative gift wraps;

FIG. 6 is a partial view of a metallic sheen stretchable hosiery netting that can be used as shown in FIG. 1 to form a decorative gift wrap;

DETAILED DESCRIPTION OF THE DRAWINGS

Figure 7:
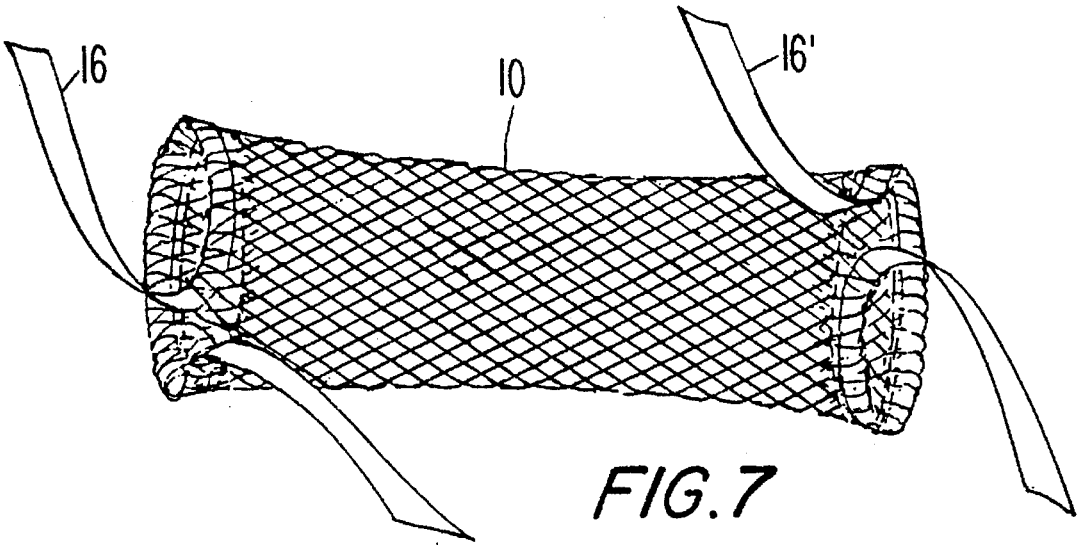
FIG. 7 is a side view of an enclosed length of a stretchable hosiery netting with a ribbon or cord at each end wthat can be adjusted to selectively open and close the ends thereof before and/or after a package is inserted therein.

While netting has been used previously as an enclosure to hold multiple objects such as marbles, potatoes, and oranges, the use of women's hosiery netting, in, for example, nylon or lycra, to be used for gift wrapping, is unknown. The formfitting aspect of such women's hosiery netting provides a new and unobvious result when used as a gift packaging wrap. FIG. 1 illustrates an enclosure formed of a length of stretchable hosiery netting 10 that may be of any well-known type such as nylon or lycra. One end 14 may be closed in any well-known manner as by sewing as indicated by the numeral 12 or could be stapled or otherwise fixedly closed. The other end 18 may have a decorative ribbon that can be utilized as a drawstring to tighten the end 18 about a package and secure the end. For ease of explanation herein, the term "tubular length" of hosiery netting will be used. Thus, the term is used in a general sense and the invention is not to be so limited specifically.

FIG. 2 is an isometric view of a package 20 inserted within the stretchable tubular length of hosiery netting 10 shown in FIG. 1. The ribbon or cord 16 has been drawn to snug the hosiery 10 around the end of the package 20 and then is tied in a bow at the top 18 thereof. The striking formfitting and decorative aspects of the netting are clearly shown in FIG. 2. The term "ribbon" as used herein is to be understood to indicate string, cord, twine, or any other elongated material that could be used for such purpose.

Thus the novel method of the present invention comprises the steps of first forming a tubular length 10 of stretchable hosiery netting as illustrated in FIG. 1. The next step is to add a closure to each end of the tubular length of hosiery netting 10 such as indicated by the stitching at 12 and the ribbon 16. At least one of the closures is adjustable to selectively open and close at least one end of the tubular hosiery netting 10 as indicated by the ribbon 16. The tubular hosiery netting 10 is then stretched to allow a package 20 of appropriate size to be inserted therein. Finally, the at least one adjustable closure such as ribbon 16 is then adjusted to close the at least one end of the tubular hosiery netting 10 to create a formfitting decorative wrap for the package 20 as shown in FIG. 2.

Since hosiery comes in different materials and designs, FIG. 3 illustrates a patterned hosiery netting that is stretchable and could be used in place of the plain design illustrated in FIG. 1. FIG. 4 illustrates a lace design that could also be used as the stretchable hosiery netting 10. FIG. 5 illustrates a nylon or lycra stretchable hosiery netting of typical style that could also be used as the netting 10 in FIG. 1. FIG. 6 illustrates a metallic sheen type hosiery material that is stretchable and could be used as the stretchable hosiery netting 10 of FIG. 1.

FIG. 7 illustrates the use of a ribbon at each end of the tubular length of stretchable hosiery netting 10 so that both ends of the netting 10 can be opened and closed by tightening the ribbons 16 and 16' in the manner of a drawstring as illustrated FIG. 1 and FIG. 2.

Figure 8:
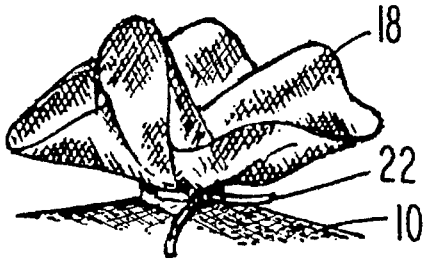
FIG. 8 illustrates a variation in a closure for one end of the elongated enclosure wherein a decorative twine, cord, or ribbon is used to wrap around the excess hosiery netting at the end of the package to form the enclosure.

FIG. 8 illustrates another type of closure where a decorative string, twine, or ribbon 22 may simply be tied around the excess hosiery material 10 at the outer end 18 as shown.

Figure 9:
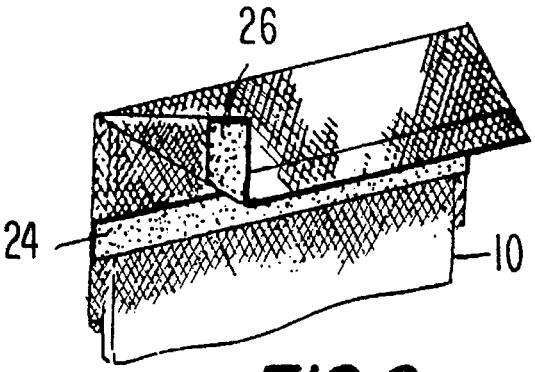
FIG. 9 illustrates the use of hook-and-loop material to form a closure for at least one end of the stretchable hosiery netting forming the decorative gift wrap.

FIG. 9 illustrates another type of adjustable closure utilizing hook-and-loop material 24 and 26, respectively, to close one or both ends of the netting 10.

Figure 10:
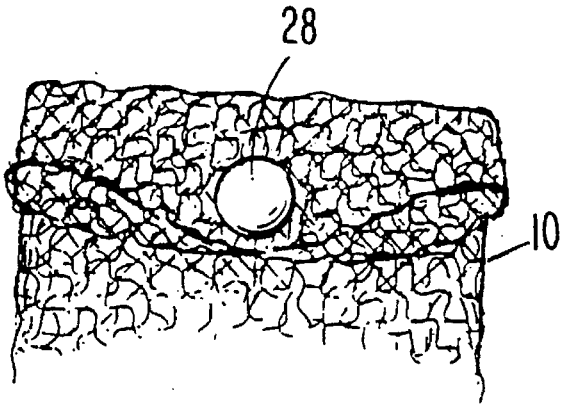
FIG. 10 is a partial view of a length of the stretchable hosiery netting enclosure illustrating the use of at least one decorative button with an associated closure element such as a snap, the bottom and associated closure element being attached to at least one end of the netting enclosure to selectively open and close the package.

Finally, FIG. 10 illustrates at least one decorative button 28 with an associated fastener of any type such as a snap or a loop that could extend around the button from the tube 10 to close either or both ends of the tubular netting 10.

Thus, there has been disclosed a novel method and apparatus for forming a gift wrap for wrapping a packaging. The decorative gift wrap comprises a tubular length of stretchable hosiery netting and a closure on each end of the tubular netting so that tubular hosiery netting can be stretched to allow a package to be inserted therein and both ends of the tubular netting closed to create a formfitting decorative wrap for the package. The closure on at least one end is selectively openable and closeable to insert and remove the package.

The method comprises the steps of forming a tubular length of stretchable hosiery netting; adding a closure to each end of the tubular length of hosiery netting, at least one of the closures being adjustable to selectively open and close at least one end of the tubular hosiery netting; stretching the tubular hosiery netting to allow a package of appropriate size to be inserted therein; and adjusting the at least one closure of the tubular netting to close the at least one end to create a formfitting decorative wrap for the package.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims. For example, stretchable plastics having similar characteristics for form fitting gift wrapping may obviously be used.

I claim:

1. A method of gift wrapping a package comprising the steps of:

forming an elongated enclosure of stretchable hosiery netting having first and second ends;

adding a closure to the first and second ends of the elongated enclosure, at least one of the closures being adjustable to selectively open and close at least one end of the hosiery netting enclosure wherein said adjustable closure is adapted to be readily reclosable;

stretching the hosiery netting to allow a package of appropriate size to be inserted in the elongated enclosure through the at least one end; and;

adjusting said reclosable closure to close said opening in at least one end of the elongated enclosure to create a formfitting decorative wrap for the package whereby the package can be decoratively wrapped in a simple and economical manner without requiring skill or undue length of time.

2. A method as in claim 1 wherein the step of forming the enclosure with the length of stretchable hosiery further comprises the step of using nylon hosiery material for the netting.

3. A method as in claim 1 wherein the step of forming the enclosure with the length of stretchable hosiery further comprises the step of using lycra hosiery material.

4. A method as in claim 1 wherein the step of forming the enclosure with the length of stretchable hosiery further comprises the step of using lace hosiery material.

5. A method as in claim 1 wherein the step of forming the enclosure with the length of stretchable hosiery further comprises the step of using metallic sheen hosiery material.

6. A method as in claim 1 wherein the step of forming the enclosure with the length of stretchable hosiery further comprises the step of using patterned hosiery material.

7. A method as in claim 1 wherein the step of adding a closure to each end of the elongated enclosure formed of the hosiery netting further comprises the steps of:

sewing one end of the elongated enclosure of hosiery netting to form a fixed, closed end; and attaching a ribbon to the other end of the netting enclosure such that, after a package is inserted in the netting enclosure, the ribbon can be used to close the adjustable end.

8. A method as in claim 1 wherein the step of adding a closure to each end of the elongated enclosure of hosiery netting further comprises the step of:

attaching a ribbon to at least one end of the netting enclosure in the form of a drawstring such that, after a package is placed in the netting enclosure, the ribbon can be used to close that one end.

9. A method of gift wrapping a package comprising the steps of:

forming an elongated enclosure of stretchable hosiery netting having first and second ends;

adding a closure to the first and second ends of the elongated enclosure, at least one of the closures being adjustable to selectively open and close at least one end of the hosiery netting enclosure;

stretching the hosiery netting to allow a package of appropriate size to be inserted in the elongated enclosure through at least one end; and adjusting said closure to close said opening in at least one end of the elongated enclosure to create a formfitting decorative wrap for the package; wherein the step of adding a closure to each end of the elongated enclosure of hosiery netting further comprises the step of:

attaching mating hook-and-loop fasteners to at least one end of the netting enclosure to selectively open and close said at least one end to secure a package within the netting conduit and enable the package to be selectively removed.

10. A method of gift wrapping a package comprising the steps of:

forming an elongated enclosure of stretchable hosiery netting having first and second ends;

adding a closure to the first and second ends of the elongated enclosure, at least one of the closures being adjustable to selectively open and close at least one end of the hosiery netting enclosure;

stretching the hosiery netting to allow a package of appropriate size to be inserted in the elongated enclosure through at least one end; and adjusting said closure to close said opening in at least one end of the elongated enclosure to create a formfitting decorative wrap for the package; wherein the step of adding a closure to each end of the elongated enclosure of hosiery netting further comprises the step of:

attaching decorative buttons with an associated fastener for each button to at least one end of the netting enclosure to selectively open and close at least one end of the netting enclosure so that it will secure a package within the netting enclosure and allow the package to be selectively removed.

11. A decorative gift wrap for wrapping a package comprising:

an elongated enclosure of stretchable hosiery netting having first and second open ends; and a closure on each open end of the netting enclosure so that the hosiery netting enclosure can be stretched to allow a package to be inserted therein and both ends of the netting enclosure closed to create a formfitting decorative wrap for the package, the closure on at least one end being selectively reclosable to enable said package to be readily inserted or removed whereby the package can be decoratively wrapped in a simple and economical manner without requiring skill or undue length of time.

12. A decorative gift wrap as in claim 11 wherein the elongated enclosure of stretchable hosiery netting comprises nylon hosiery material.

13. A decorative gift wrap as in claim 11 wherein the elongated enclosure of stretchable hosiery netting comprises lycra hosiery material.

14. A decorative gift wrap as in claim 11 wherein the elongated enclosure of stretchable hosiery netting comprises lace hosiery material.

15. A decorative gift wrap as in claim 11 wherein the elongated enclosure of stretchable hosiery netting comprises metallic sheen hosiery material.

16. A decorative gift wrap as in claim 11 wherein the elongated enclosure of stretchable hosiery netting comprises patterned hosiery material.

17. A decorative gift wrap as in claim 11 wherein the closure on the ends of the elongated enclosure of hosiery netting comprises:

stitching on one end of the elongated enclosure to form a fixed closed end; and a ribbon attached to the other end of the elongated enclosure such that, after a package is inserted in the elongated enclosure, the ribbon can be used to close the adjustable end.

18. A decorative gift wrap as in claim 11 wherein the closure on at least one end of the elongated enclosure comprises a ribbon attached to at least one end such that, after a package is placed in the elongated enclosure, the ribbon can be used to close said one end.

19. A decorative gift wrap for wrapping a package comprising:

an elongated enclosure of stretchable hosiery netting having first and second open ends; and a closure on each open end of the netting enclosure so that the hosiery netting enclosure can be stretched to allow a package to be inserted therein and both ends of the netting enclosure closed to create a formfitting decorative wrap for the package, the closure on at least one end being selectively openable to enable said package to be removed; wherein the closure on at least one end of the elongated enclosure of hosiery netting comprises mating hook-and-loop fasteners to selectively open and close at least one end to secure a package within the netting enclosure and enable the package to be selectively removed.

20. A decorative gift wrap for wrapping a package comprising:

an elongated enclosure of stretchable hosiery netting having first and second open ends; and a closure on each open end of the netting enclosure so that the hosiery netting enclosure can be stretched to allow a package to be inserted therein and both ends of the netting enclosure closed to create a formfitting decorative wrap for the package, the closure on at least one end being selectively openable to enable said package to be removed;

wherein one closure on at least one end of said netting enclosure comprises at least one decorative button with an associated fastener for said button attached to at least one end of the netting enclosure to selectively open and close at least one end of the netting enclosure so that it will secure a package within the enclosure and allow the package to be selectively removed.

* * * * *